US010012039B2

(12) United States Patent
Guerra et al.

(10) Patent No.: US 10,012,039 B2
(45) Date of Patent: Jul. 3, 2018

(54) TUBULAR HANDLING SYSTEM

(71) Applicant: FORUM US, INC., Houston, TX (US)

(72) Inventors: Gerardo Guerra, Houston, TX (US); Aaron Bryant, Tomball, TX (US)

( * ) Notice: Subject to any disclaimer, the term of this patent is extended or adjusted under 35 U.S.C. 154(b) by 0 days.

(21) Appl. No.: 15/096,670

(22) Filed: Apr. 12, 2016

(65) Prior Publication Data

US 2016/0305203 A1 Oct. 20, 2016

Related U.S. Application Data

(60) Provisional application No. 62/147,728, filed on Apr. 15, 2015.

(51) Int. Cl.
*E21B 19/15* (2006.01)

(52) U.S. Cl.
CPC ..... *E21B 19/155* (2013.01)

(58) Field of Classification Search
CPC ..... E21B 19/00; E21B 19/15; E21B 19/155; E21B 19/14; E21B 19/18; E21B 19/20
USPC ..... 414/22.51–22.71
See application file for complete search history.

(56) References Cited

U.S. PATENT DOCUMENTS

RE24,907 E * 12/1960 Maydew ..... E21B 19/155 414/22.59
3,655,071 A * 4/1972 Langowski ..... E21B 19/155 414/22.58
4,042,123 A * 8/1977 Sheldon ..... E21B 19/20 175/85
4,382,591 A * 5/1983 Minnis ..... E21B 19/155 269/156
4,552,498 A * 11/1985 Dysarz ..... E21B 19/155 414/22.58
6,695,559 B1 * 2/2004 Pietras ..... E21B 19/00 414/22.57
7,431,550 B2 10/2008 Thompson
7,540,338 B2 * 6/2009 Belik ..... E21B 19/155 175/52
7,552,775 B2 * 6/2009 Pietras ..... E21B 19/155 166/380
8,033,779 B2 * 10/2011 Gerber ..... E21B 19/15 14/71.1
2004/0131449 A1 7/2004 Thompson
(Continued)

FOREIGN PATENT DOCUMENTS

WO 03093629 A1 11/2003

OTHER PUBLICATIONS

International Search Report and Written Opinion, PCT Application No. PCT/US2016/027124, dated Jul. 6, 2016.
(Continued)

*Primary Examiner* — Anna M Momper
*Assistant Examiner* — Lynn E Schwenning
(74) *Attorney, Agent, or Firm* — Ira Domnitz

(57) ABSTRACT

A tubular handling system comprising a catwalk having a trough, a tailing member coupled to the trough, and a catcher coupled to the tailing member. The catcher is moveable relative to the tailing member. The system further includes a support structure coupled to the tailing member at one end and coupled to the trough at an opposite end. The support structure is configured to move the tailing member relative to the trough to guide a tubular from a substantially horizontal or slightly angled position to a substantially vertical position.

18 Claims, 11 Drawing Sheets

(56) References Cited

U.S. PATENT DOCUMENTS

| | | | | |
|---|---|---|---|---|
| 2006/0243488 | A1 | 11/2006 | Pietras | |
| 2009/0151955 | A1* | 6/2009 | Bamford | E21B 3/045<br>166/335 |
| 2011/0188973 | A1* | 8/2011 | Baumler | E21B 19/15<br>414/22.57 |
| 2014/0151021 | A1 | 6/2014 | Yorga et al. | |

OTHER PUBLICATIONS

Anonymous, Riser Stake, Retrieved from Internet at: http://www.efcgroup.net/products/mechanical-handling/horizontal-tubular-handling/riser-skate, Feb. 15, 2015, pp. 1-2.

* cited by examiner

TUBULAR HANDLING SYSTEM

CROSS-REFERENCE TO RELATED APPLICATION

This application claims benefit of U.S. Provisional Patent Application Ser. No. 62/147,728, filed Apr. 15, 2015, the entirety of which is incorporated by reference herein.

BACKGROUND

Field of the Disclosure

Embodiments of the disclosure generally relate to a system for conveying tubulars from a catwalk onto a rig floor, and from the rig floor back onto the catwalk.

Description of the Related Art

In a drilling or rig work-over operation, whether on a water-based or a land-based drilling rig, drill pipe, casing, conductor pipe, or other tubulars are often stored at a storage level, that is at a lower elevation than the rig floor because rig floor space is limited. Operators typically use a catwalk to convey the tubulars between the storage level and the rig floor. The tubulars are positioned in a trough of the catwalk, raised to an elevation near the rig floor, and conveyed (e.g., pushed and/or pulled) from the trough onto the rig floor.

Specifically, each tubular is moved and raised to the rig floor by the catwalk in a substantially horizontal or slightly angled position. A leading end (e.g. the upper end) of the tubular is then engaged by a hoist and raised from the trough. As the leading end of the tubular is being raised, the tailing end (e.g. the lower end) of the tubular is pushed and/or dragged along the trough. When the tailing end of the tubular reaches the end of the trough, the tailing end of the tubular may swing off of the trough and over the rig floor (for example, like a pendulum) until the tubular stabilizes and raised into a substantially vertical position by the hoist. In this manner, the tubular is moved from a substantially horizontal position to a substantially vertical position onto the rig floor.

A separate tailing system is used to help guide the tailing end of the tubular when moving from the end of the trough onto the rig floor to prevent uncontrolled swinging of the tubular. One problem with existing tailing systems is that they cannot accommodate tubulars of variable ranges and sizes, and therefore inserts and other parts are required to be used depending on the size of tubular required on the rig floor. Additionally, other hardware may be required to be changed out, thus creating additional processes that must be completed to transition between tubulars of different sizes. Other problems include unsafe guiding and controlling tubulars between the substantially horizontal or slightly angled position and the substantially vertical position, as prior art systems require a deck hand using a rope, chain, and/or additional equipment to control and stabilize the swing of the tubular.

Accordingly, it would be useful to have one system to accommodate and guide tubulars of varying sizes between a substantially horizontal or slightly angled position and a substantially vertical position in a hands-off and seamless operation, which requires no change in hardware or additional equipment and provides increased safety.

SUMMARY

In one embodiment, a tubular handling system comprises a catwalk having a trough; a tailing member coupled to the trough; a catcher coupled to the tailing member, wherein the catcher is moveable relative to the tailing member; and a support structure coupled to the tailing member at one end and coupled to the trough at an opposite end, wherein the support structure is configured to move the tailing member relative to the trough to guide a tubular from a substantially horizontal or slightly angled position to a substantially vertical position.

In one embodiment, a method of moving a tubular from a substantially horizontal or slightly angled position in a trough of a catwalk to a substantially vertical position on a rig floor using a tailing arm system comprises actuating the tailing arm system into a catching position such that a tailing member and a catcher of the tailing arm system are configured to engage a tailing end of the tubular while a leading end of the tubular is lifted from the trough of the catwalk, wherein the catcher is coupled to one end of the tailing member, and wherein an opposite end of the tailing member is coupled to and movable relative to the trough; engaging the tailing end of the tubular with the catcher as the tubular is lifted; and guiding the tailing end of the tubular with the catcher from the trough to the rig floor by moving the tailing member relative to the trough to move the tubular into the substantially vertical position.

In one embodiment, a method of moving a tubular from a substantially vertical position on a rig floor to a substantially horizontal or slightly angled position in a trough of a catwalk using a tailing arm system comprises actuating the tailing arm system into a catching position such that a tailing member and a catcher of the tailing arm system are configured to engage a tailing end of the tubular while a leading end of the tubular is lowered onto the trough of the catwalk, wherein the catcher is coupled to one end of the tailing member, and wherein an opposite end of the tailing member is coupled to and movable relative to the trough; engaging the tailing end of the tubular with the catcher as the tubular is lowered; and guiding the tailing end of the tubular with the catcher from the rig floor to the trough by moving the tailing member relative to the trough to move the tubular into the substantially horizontal or slightly angled position.

BRIEF DESCRIPTION OF THE DRAWINGS

So that the manner in which the above recited features of the disclosure can be understood in detail, a more particular description of embodiments of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments described herein generally relate to a tubular handling system configured to convey tubulars of various diameters onto and from a rig floor. The term "tubular" as used herein includes but is not limited to, drill pipe, conductor pipe, and other hollow, thin or thick walled piping that can be used on oil and gas rigs to facilitate the drilling or completion of a wellbore. The tubulars may have a variety of sizes, strengths, materials, and weights. The term "tubular" is not intended to be limiting and may include various examples beyond those described.

Figure 1A:
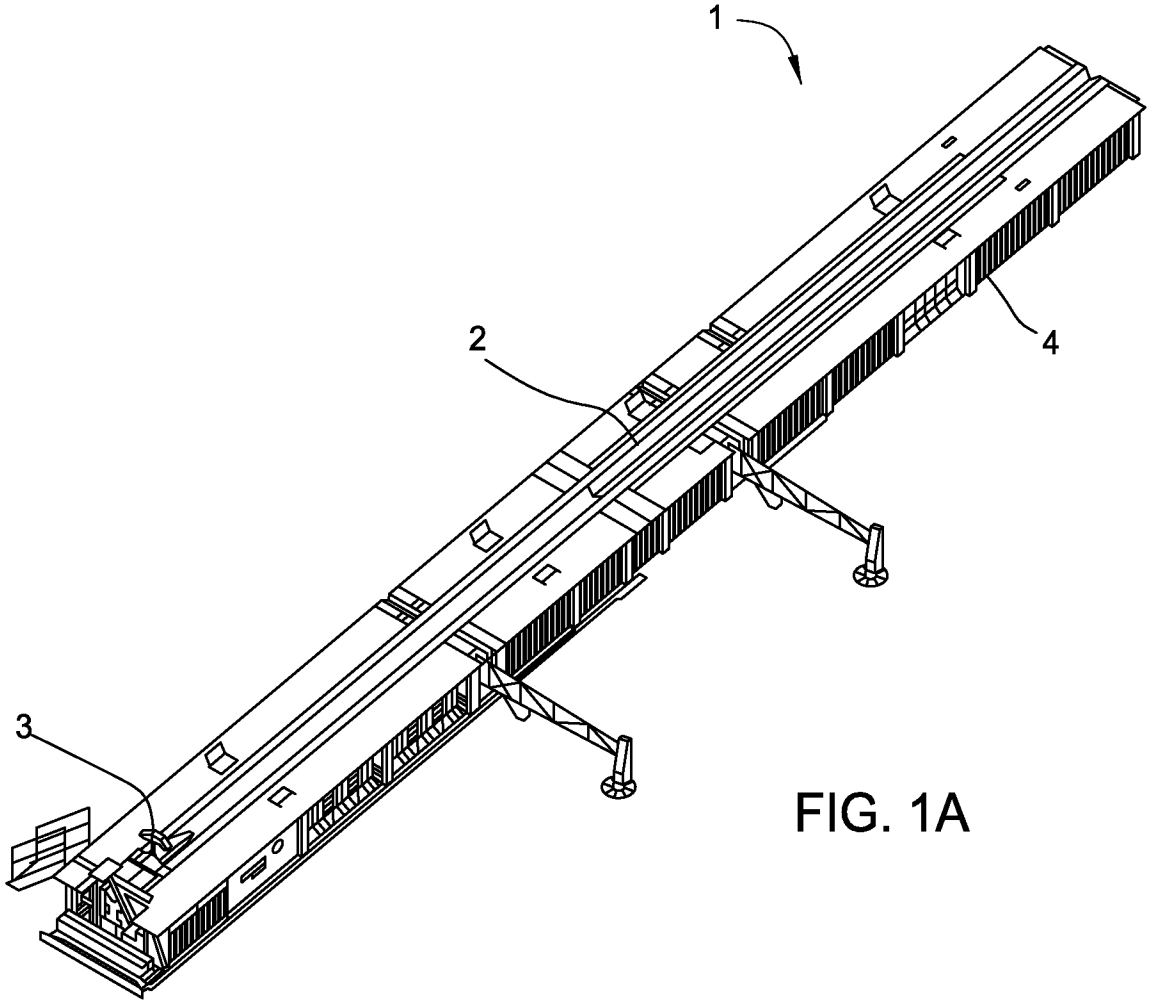
FIG. 1A illustrates an embodiment of a catwalk in a stored position in which tubular are loaded into or unloaded from a trough of the catwalk.

FIG. 1A illustrates a catwalk 1 having a trough 2 into which one or more tubulars are loaded. The trough 2 may be supported by a frame 4 of the catwalk 1. When positioned in the trough 2, the tubulars are moved (e.g. pushed) along the trough 2 by a skate 3 to move the tubulars toward the end of the trough and onto a rig floor. As illustrated in FIG. 1A, the trough 2 is in a stored position within the frame 4 of the catwalk 1. The catwalk 1 can accommodate tubulars having diameters between about one-inch to about thirty-five inches.

Figure 1B:
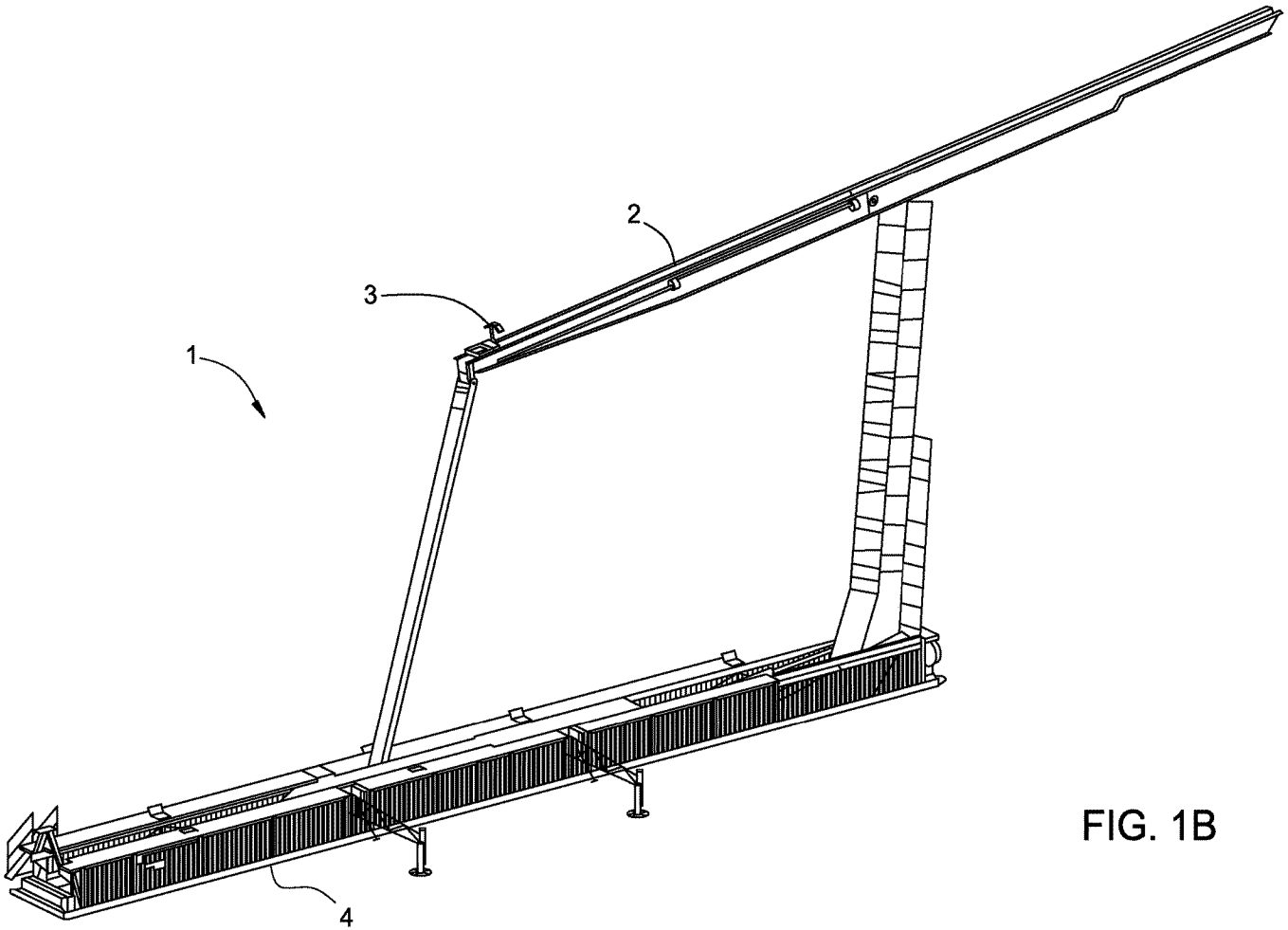
FIG. 1B illustrates the catwalk in an extended position in which tubulars can be moved to a rig floor.

FIG. 1B illustrates the trough 2 of the catwalk 1 raised into an extended position above the frame 4 to convey tubulars from a lower elevation to a higher elevation, such as onto a rig floor. When positioned in the trough 2, the tubulars may be oriented in a substantially horizontal or slightly angled position, and then subsequently moved into a substantially vertical position on the rig floor as further described below. In the embodiments described herein, when describing orienting a tubular between a substantially horizontal or slightly angled position and a substantially vertical position, the trough 2 of the catwalk 1 may be in the extended position.

Figure 2A:
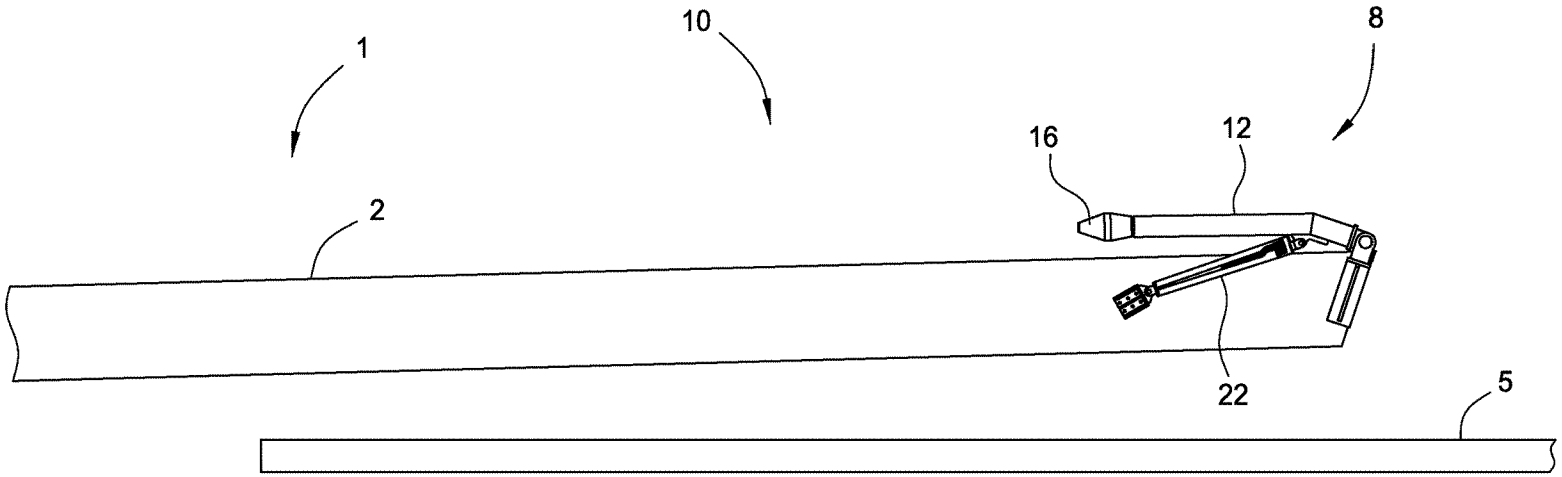
FIG. 2A illustrates an embodiment of a tubular handling system with tailing members and catchers in a stored position and operatively connected to the trough of the catwalk.

FIG. 2A illustrates an embodiment of a tubular handling system 10. The tubular handling system 10 includes the catwalk 1 and a tailing arm system 8 coupled to the trough 2 of the catwalk 1. As illustrated in FIG. 2A, the trough 2 is in the extended position and at least partially extends over a rig floor 5. The tailing arm system 8 has at least one tailing member 12, which is movable relative to the trough 2 to help guide tubulars (having diameters of about one inch to about thirty-five inches) off of and onto the trough 2. The tailing member 12 may be a cylindrically shaped member, a squared shaped member, a truss shaped member, or any other support structure capable of guiding, bracing, and/or supporting a tubular.

One end of the tailing member 12 may be connected to the trough 2 such that the tailing member 12 can pivot towards and away from the trough 2. The tailing member 12 may be configured to move through a 180 degree angle of rotation. The tailing member 12 may be connected to the trough 2 by a welded connection, a pin and hook connection, a nut and bolt connection, a screw connection, or any other suitable connection mechanism or method.

The tailing arm system 8 has at least one catcher 16 coupled to the opposite end of the tailing member 12. The catcher 16 may have a cylindrically shaped body, or a sloping cylindrical body where the diameter of the body is greatest about the midpoint of the body and decreases towards the ends of the body. Alternatively, the catcher 16 may have a body of any other shapes.

The catcher 16 is movable relative to the tailing member 12 between an open position and a closed position, such as by a motor (not shown). When in the open position, the longitudinal axis of the catcher 16 is aligned with the longitudinal axis of the tailing member 12. When in the closed position, the longitudinal axis of the catcher 16 is perpendicular with the longitudinal axis of the tailing member 12. When in the closed position, the catcher 16 may be configured to support an end of a tubular while the end of the tubular is guided by the tailing member 12 as further described below. The catcher 16 is also rotatable relative to the tailing member 12 as a tubular is moved along the catcher 16 when the tubular is being raised or lowered.

The tailing arm system 8 may also be moveable into a stored position where the longitudinal axis of the tailing member 12 and the catcher 16 are positioned substantially parallel to the longitudinal axis of the trough 2 of the catwalk 1. While in the stored position, the tailing arm system 8 may be in a location relative to the trough 2 that protects the tailing member 12 and the catcher 16 from interference with other peripheral equipment. The catcher 16 may be in the open position when the tailing arm system 8 is in the stored position.

The tubular handling system 10 may further include a support structure 22 that is coupled to the tailing member 12 at one end, and coupled to the trough 2 of the catwalk 1 an opposite end. The support structure 22 may be coupled to the tailing member 12 and/or the trough 2 via a nut and bolt connection, a screw connection, a pin and hook connection, a welded connection, and/or the like. The support structure 22 is configured to support and move the tailing member 12 relative to the trough 2 when the tailing member 12 and the catcher 16 are guiding a tubular to and from the rig floor 5 as further described below. The support structure 22 may include a rod member that extends and retracts from a cylinder using a hydraulic, pneumatic, electric, and/or mechanical force. For example, the support structure 22 may be a hydraulic lift arm, an extendable member, a motorized member, and/or the like.

Figure 2B:
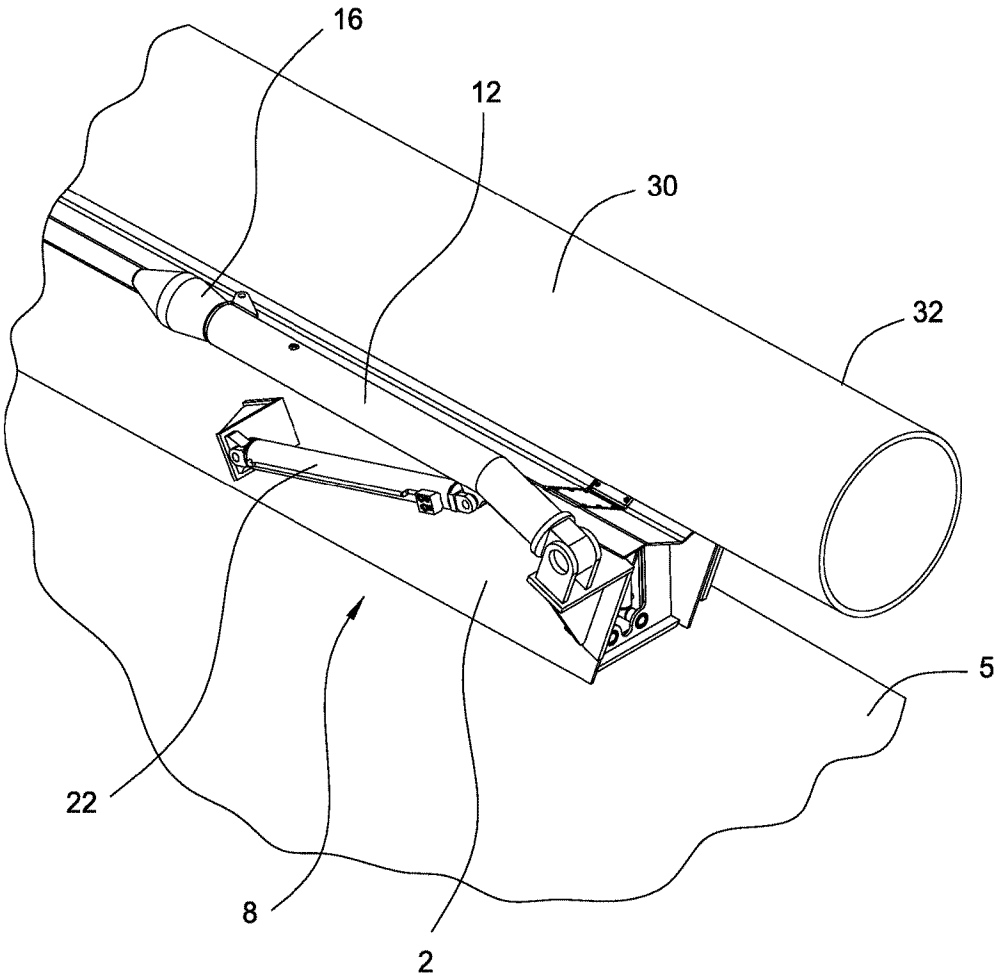
FIG. 2B illustrates an embodiment of the tubular handling system with a tubular positioned in the trough of the catwalk. In the embodiment shown, the tailing members and catchers are in the stored position and are operatively connected to the catwalk.

FIG. 2B shows an embodiment of the tailing arm system 8 in the stored position along the sidewall of the trough 2.

While in the stored position, the support structure 22 is retracted to position the tailing member 12 and the catcher 16 substantially parallel to the trough 2. A tubular 30 positioned in the trough 2 has been moved toward an end of the trough 2 (such as by being pushed by the skate 3 shown in FIG. 1) and remains in a substantially horizontal or slightly angled position. The tubular 30 must be brought from the substantially horizontal or slightly angled position on the trough 2 to a substantially vertical position on the rig floor 5.

Figure 4:
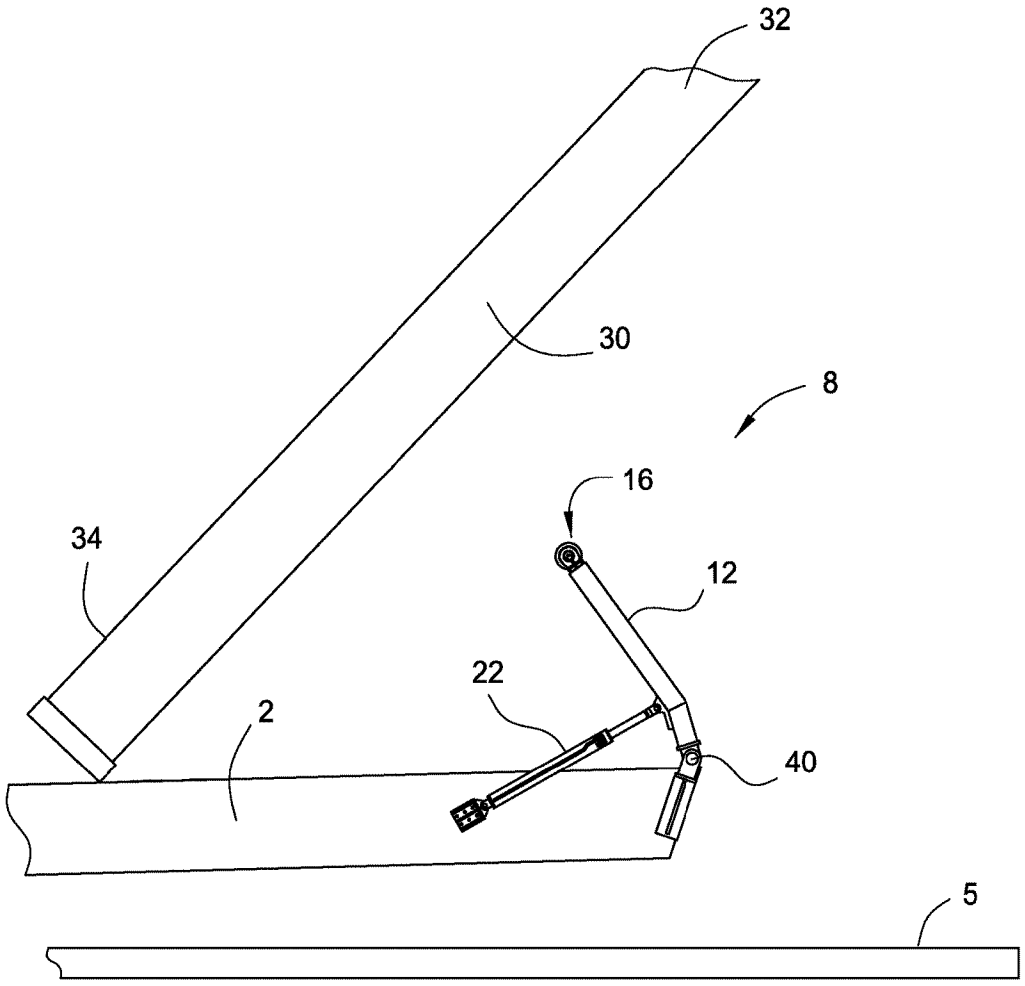
FIG. 4 illustrates an embodiment of the tubular handling system in which the tubular is being lifted from the trough of the catwalk onto the rig floor. In the embodiment shown, the tailing members and catchers are actuated into a catching position.

The tubular 30 may be lifted from the trough 2 of the catwalk 1 by a hoist (not shown) that engages a leading end 32 (e.g. the upper end) of the tubular 30. As the hoist raises the tubular 30 from the trough 2, an opposite, tailing end 34 (e.g. the lower end as shown in FIG. 4) of the tubular 30 slides, is dragged, and/or is pushed via the skate 3 (as seen in FIG. 1) along the trough 2. The tailing end 34 of the tubular 30 may swing uncontrollably off of the trough 2 upon reaching the substantially vertical position without the use of the tailing arm system 8. Prior methods of controlling tubulars transitioning to the substantially vertical position have included the use of a deckhand to catch the tubular by using a rope or chain to prevent the tubular from dangerously swinging over the rig floor and/or into nearby equipment or individuals.

Figure 3:
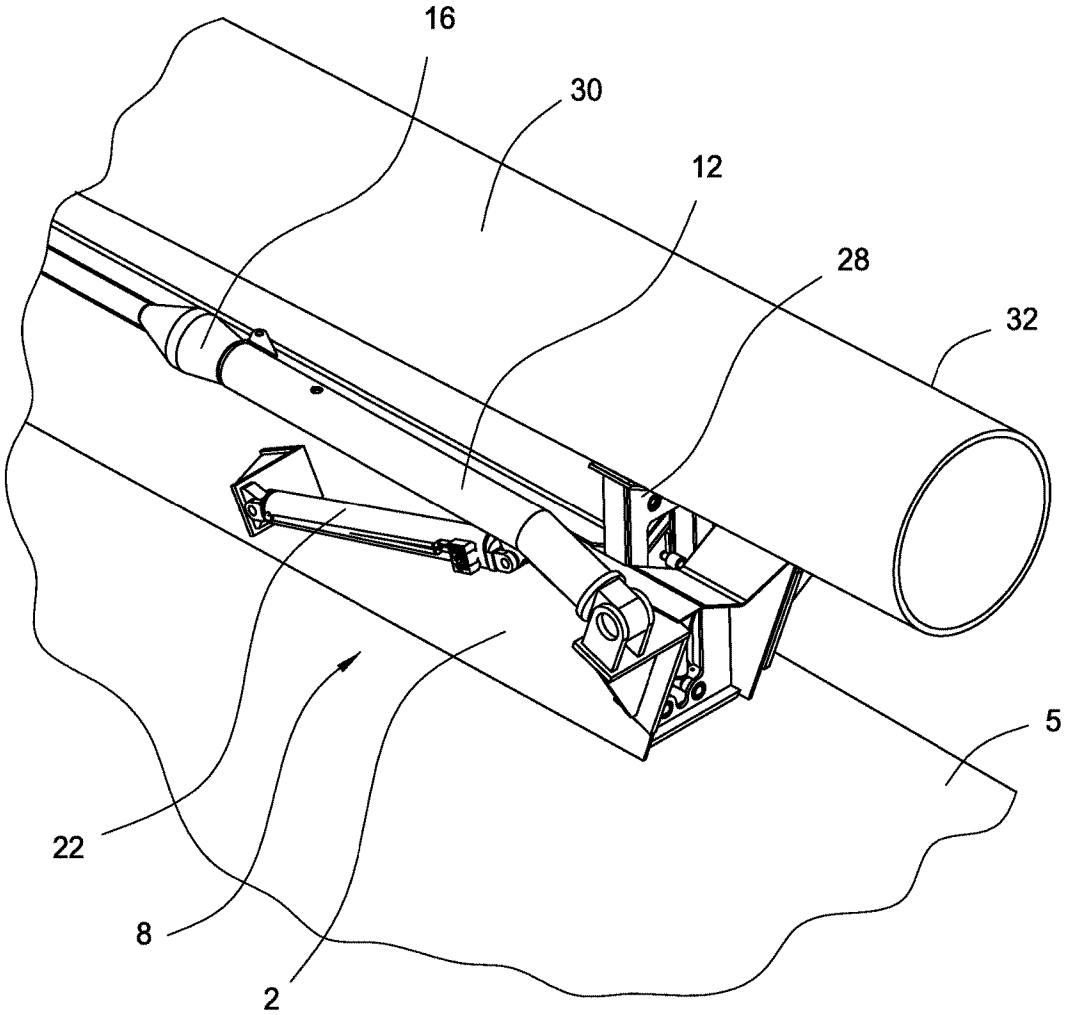
FIG. 3 illustrates an embodiment of the tubular handling system in which a tubular lift system is extended to lift the tubular from the trough of the catwalk.

As shown in FIG. 3, after the leading end 32 of the tubular 30 has been moved to the end of the trough 2 closest to the rig floor 5, then the leading end 32 of the tubular 30 is optionally lifted up from the trough 2 via a tubular lift system 28. The tubular lift system 28 lifts the tubular 30 up slightly to allow a hoist to easily engage and subsequently raise the tubular 30 onto the rig floor 5. While the tubular lift system 28 is lifting the tubular 30, the tailing arm system 8 may remain in the stored position.

As shown in FIG. 4, the leading end 32 of the tubular 30 has been lifted from the trough 2 while the tailing end 34 of the tubular 30 remains in contact with the trough 2. The tailing end 34 of the tubular 30 may slide, be dragged, and/or pushed along the trough 2 as the leading end 32 of the tubular 30 is lifted by the hoist. The tubular 30 is being moved from the substantially horizontal or slightly angled position to a substantially vertical position.

As further shown in FIG. 4, the tailing arm system 8 is actuated into a catching position, such that the tailing member 12 is no longer parallel to the trough 2 and moved by the support structure 22 about a pivot point 40 by which the tailing member 12 is operatively connected to the trough 2. The support structure 22 may include a hydraulically, pneumatically, electrically, and/or mechanically actuated rod member that extends to raise and move the tailing member 12 about the pivot point 40. For example, the support structure 22 may include a hydraulic lift arm that is actuated by pressurized hydraulic fluid to extend and retract the hydraulic lift arm to move the tailing member 12 about the pivot point 40. With the tailing arm system 8 in the catching position, the catcher 16 is actuated into the closed position such that the longitudinal axis of the catcher 16 is substantially perpendicular to the longitudinal axis of the tailing member 12.

Figure 5B:
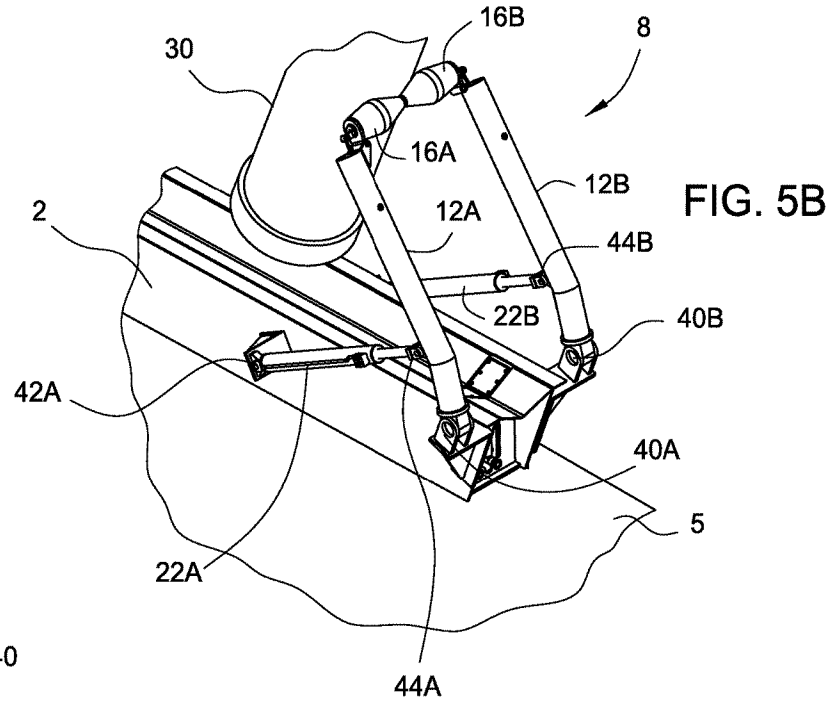
FIGS. 5A and 5B illustrate an embodiment of the tubular handling system in which the tubular is being lifted off of the trough of the catwalk and a tailing end of the tubular engaging the catchers.
Figure 5A:
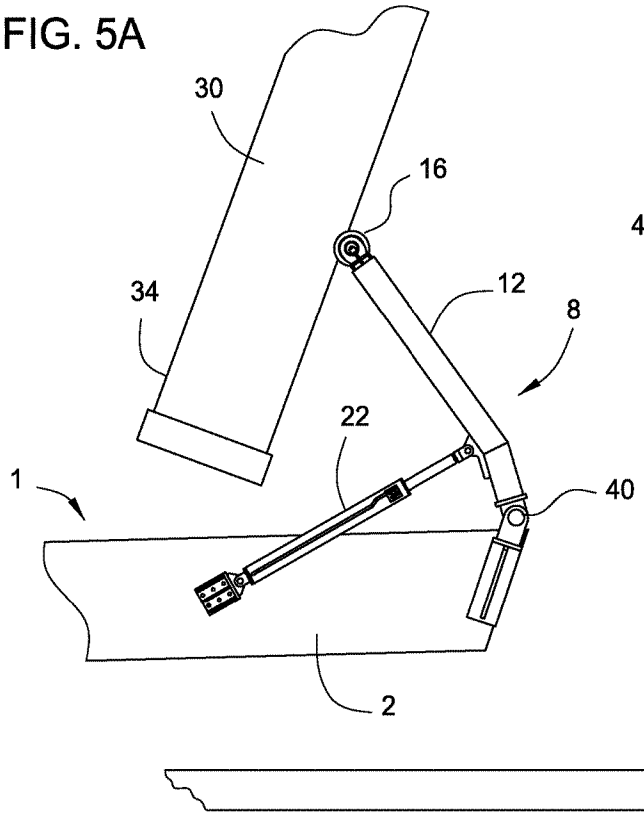

As shown in FIG. 5A, the tubular 30 is lifted until the tailing end 34 of the tubular 30 engages the catcher 16, which supports and guides the tubular 30 such that the tailing end 34 of the tubular 30 does not swing uncontrollably from the trough 2. The catcher 16, which is moved along with the tailing member 12, guides the tailing end 34 of the tubular 30 into a substantially stable and vertical position over the rig floor 5. The tubular 30 may rest within the contours of the shape of the catcher 16 as shown in FIG. 5B.

As the tubular 30 is further lifted, the catcher 16 guides the tailing end 34 of the tubular 30 over the rig floor 5 while extending (for example hydraulic lift arms of) the support structure 22 to move the tailing member 12 about the pivot point 40 and relative to the trough 2 of the catwalk 1. Additionally, the catcher 16 may roll about its longitudinal axis and relative to the tailing member 12 so that the tubular 30 does not drag along the catcher 16 while being raised. In this manner, the tailing arm system 8 of the tubular handling system 10 moves in operation with the hoist and the movement of the tubular 30 to control the movement of the tubular 30 from the substantially horizontal position to the substantially vertical position.

As shown in FIG. 5B, the tailing arm system 8 may comprise two tailing members 12A, 12B. The two tailing members 12A, 12B shown in FIG. 5B may be the same as and/or operate in the same manner as the tailing member 12 described above. Each tailing member 12A, 12B may have a catcher 16A, 16B that is the same as and/or operates in the same manner as the catcher 16 described above.

Each tailing member 12A, 12B may be operatively connected to a support structure 22A, 22B respectively. The support structure 22A, 22B may be the same as and/or operate in the same manner as the support structure 22 described above. Each support structure 22A, 22B may support and move each tailing member 12A, 12B respectively about a pivot 40A, 40B respectively.

The first support structure 22A may have a first end 44A coupled to the first tailing member 12A, and a second end 42A coupled to the trough 2 of the catwalk 1. The second end 42A of the first support structure 22A may be coupled to the trough 2 of the catwalk 1 via a pin and hook connection, a screw connection, a welded connection, a nut and bolt connection, or by any other suitable connection. The second support structure 22B may have a first end 44B coupled to the second tailing member 12B, and a second end 42B (not shown) coupled to the trough 2 of the catwalk 1. The second end 42B of the second support structure 22B may be coupled to the trough 2 of the catwalk 1 via a pin and hook connection, a screw connection, a welded connection, a nut and bolt connection, or by any other suitable connection.

Furthermore, each catcher 16A, 16B may be connected with a motor (not shown) capable of moving the catcher 16A, 16B between an open position and a closed position, as described above. The open position may be utilized by the catcher 16A, 16B when the tailing arm system 8 is in the stored position as shown in FIGS. 2A, 2B, and 3. The closed position may be utilized when tailing arm system 8 is ready to receive or support a tubular 30 as shown in FIGS. 4, 5A, and 5B.

Figure 6B:
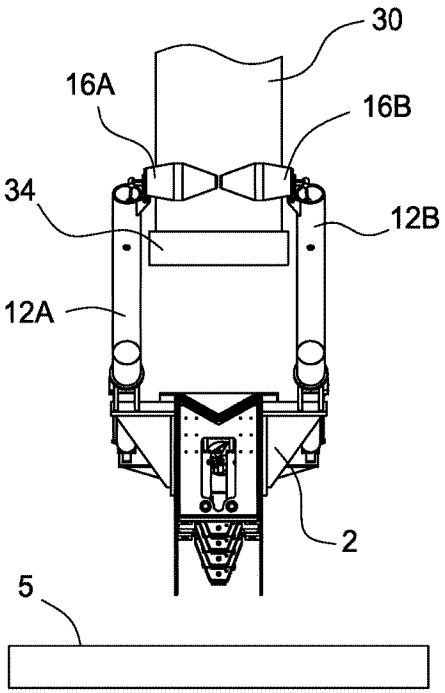
FIGS. 6A and 6B illustrate an embodiment of the tubular handling system in which the tailing end of the tubular is guided by the tailing members and the catchers into a substantially vertical position.
Figure 6A:
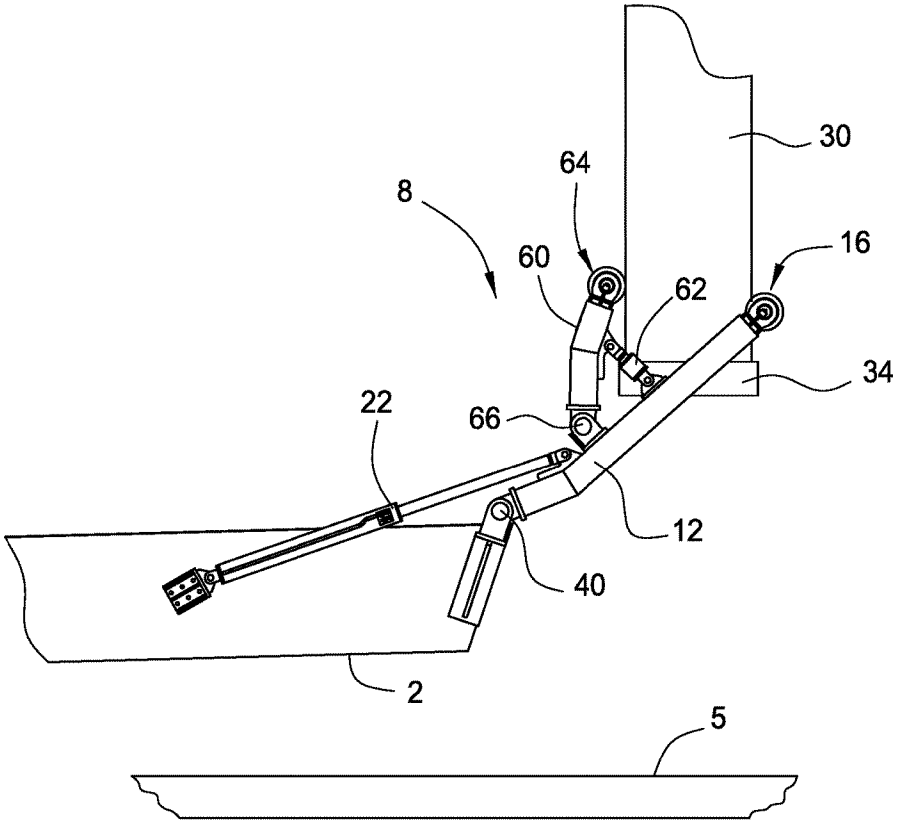

As shown in FIG. 6A, the support structure 22 is fully extended and the tailing member 12 has extended about the pivot point 40 beyond an end of the trough 2 of the catwalk 1. While in the position shown in FIG. 6A, the tubular 30 is in a substantially vertical position and no longer supported by the trough 2 of the catwalk 1. As shown, the tailing member 12 and the catcher 16 may help stabilize and/or prevent (or limit) lateral movement of the tubular 30, while permitting the tubular 30 to be raised and lowered. Increased rig and deckhand safety results by preventing the uncontrolled movement of the tubular 30, such as a swinging of the tubular 30. As such, the tubular 30 is prevented from colliding with other objects or people on or near the location where the tubular 30 is moved from the substantially horizontal or slightly angled position on the trough 2 to the substantially vertical position over the rig floor 5.

As shown in FIG. 6A only, optionally and in certain embodiments, is a second tailing member 60 having a second catcher 64 that may be included as part of the tubular handling system 10. In some embodiments, two or more second tailing members 60 and second catchers 64 may be utilized. As shown, the second tailing member 60 and the second catcher 64 may be actuated into engagement with the tubular 30 to support (e.g. guide, stabilize, prevent, and/or limit) lateral movement of the tubular 30 from the side opposite the tailing member 12 and the catcher 16, while permitting the tubular 30 to be raised and lowered. The second tailing member 60 and the second catcher 64 may limit swinging movement of the tubular 30 back toward the catwalk 1, thus securing the tubular 30. The second tailing member 60 may be substantially similar to the tailing member 12 discussed above, and the second catcher 64 may be similar to the catcher 16 discussed above.

One end of the second tailing member 60 may be coupled to the tailing member 12 about a second pivot point 66 to allow the second tailing member 60 to pivot, such as through at least a 180 degree angle of rotation, towards and away from the tailing member 12 and the trough 2. The second tailing member 60 may be connected to the tailing member 12 at the second pivot point 66 by a welded connection, a pin and hook connection, a nut and bolt connection, a screw connection, or any other suitable connection mechanism or method.

The second tailing member 60 has at least one second catcher 64 coupled to the opposite end of the second tailing member 60. The second catcher 64 is movable relative to the second tailing member 60 between an open position and a closed position, such as by a motor. When in the open position, the longitudinal axis of the second catcher 64 is aligned with the longitudinal axis of the second tailing member 60. When in the closed position, the longitudinal axis of the second catcher 64 is perpendicular with the longitudinal axis of the second tailing member 60. When in the closed position, the second catcher 64 may be configured to support an end of a tubular while the tubular is being guided onto the rig floor 5 by the tailing member 12 and the second tailing member 60. The second catcher 64 is also rotatable relative to the second tailing member 60 as a tubular is moved along the second catcher 64 when the tubular is being raised or lowered.

The second tailing member 60 may also be moveable into a stored position where the longitudinal axis of the second tailing member 60 and the second catcher 64 are positioned substantially parallel to the longitudinal axis of the tailing member 12. The second catcher 64 may be in the open position when the second tailing member 60 is in the stored position.

The second tailing member 60 may further include a second support structure 62 that is coupled to the second tailing member 60 at one end, and coupled to the tailing member 12 at an opposite end. The second support structure 62 may be coupled to the second tailing member 60 and/or the tailing member 12 via a nut and bolt connection, a screw connection, a pin and hook connection, a welded connection, and/or the like. The second support structure 62 may be configured to support and move the second tailing member 60 relative to the trough 2 and/or the tailing member 12 when the second tailing member 60 and the second catcher 64 are guiding a tubular to and from the rig floor 5, as further described below.

In one embodiment, the second support structure 62 may be one or more rotary actuators. The second support structure 62 may include a rotary actuator that is actuated using a hydraulic, pneumatic, electric, and/or mechanical force to rotate and move the second tailing member 60 into and out of engagement with a tubular. In one embodiment, the second support structure 62 may be one or more linear actuators. The second support structure 62 may include a linear actuator, such as a rod member that extends and retracts from a cylinder using a hydraulic, pneumatic, electric, and/or mechanical force to move the second tailing member 60 into and out of engagement with a tubular. The second support structure 62 may be a hydraulic lift arm, an extendable member, a motorized member, and/or the like.

As shown in FIG. 6B, the catchers 16A, 16B are in the closed position such that the longitudinal axes of the catchers 16A, 16B are aligned and/or coplanar with each other. The longitudinal axes of the catchers 16A, 16B may perpendicular to the longitudinal axes of the tailing members 12A, 12B, respectively, while the catchers 16A, 16B are in the closed position.

Figure 7B:
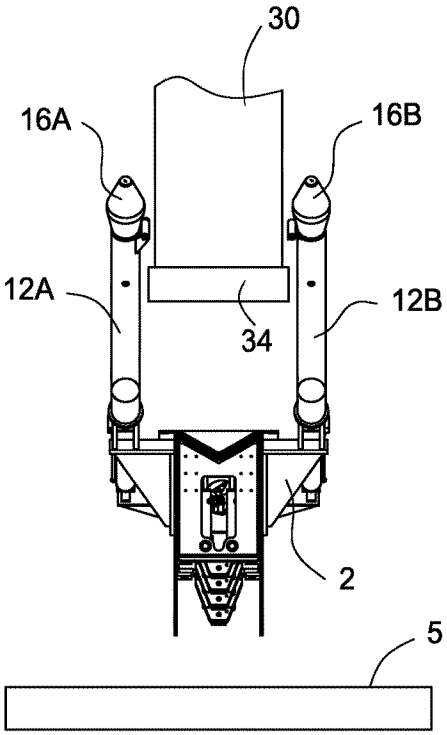
FIGS. 7A and 7B illustrate an embodiment of the tubular handling system in which the tubular has reached the substantially vertical position, and the catchers actuated into an open position and out of engagement with the tubular.
Figure 7A:
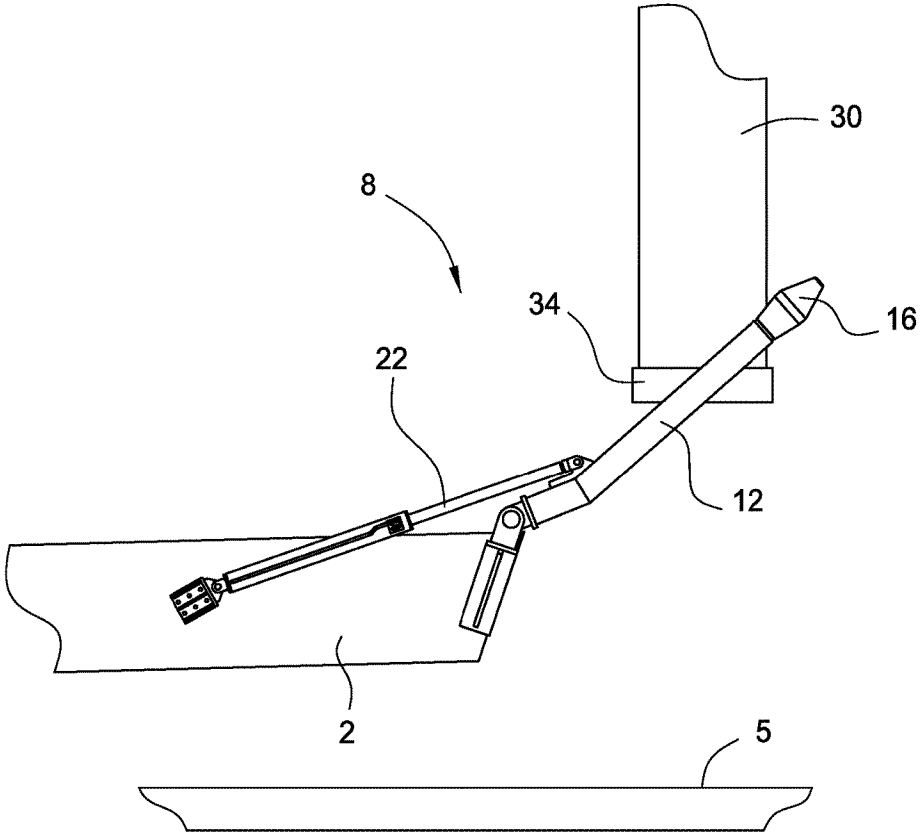

As shown in FIGS. 7A and 7B, once the tubular 30 has been stabilized in the substantially vertical position, the catchers 16A, 16B may be actuated into the open position. The longitudinal axes of the catchers 16A, 16B may be parallel to each other when the catchers 16A, 16B are in an open position. Once the catchers 16A, 16B are in the open position, the tubular 30 can be safely moved to another location on the rig floor 5. To prevent damage to the catchers 16A, 16B and/or the tailing members 12A, 12B, the tailing arm system 8 may be returned to the stored position.

The tailing members 12, 12A, 12B and catchers 16, 16A, 16B utilized on the tailing arm system 8 of the tubular handling system 10 are capable of controlling the movement of tubulars of varying sizes, ranging from about one inch in diameter to about thirty-five inches in diameter without any requirement to change any parts of the tubular handling system 10. The tailing arm system 8 may be a system separate from the catwalk 1, may be connected to the catwalk 1, or may be integral with the catwalk 1. The tubular handling system 10 may be controlled, operated, accessed, and/or utilized from a remote location, such as an off-site location. A controller may be in communication with the catwalk 1 and/or the tailing arm system 8 that is configured to send and/or receive operational instructions to and from the catwalk 1 and/or the tailing arm system 8.

Figure 8:
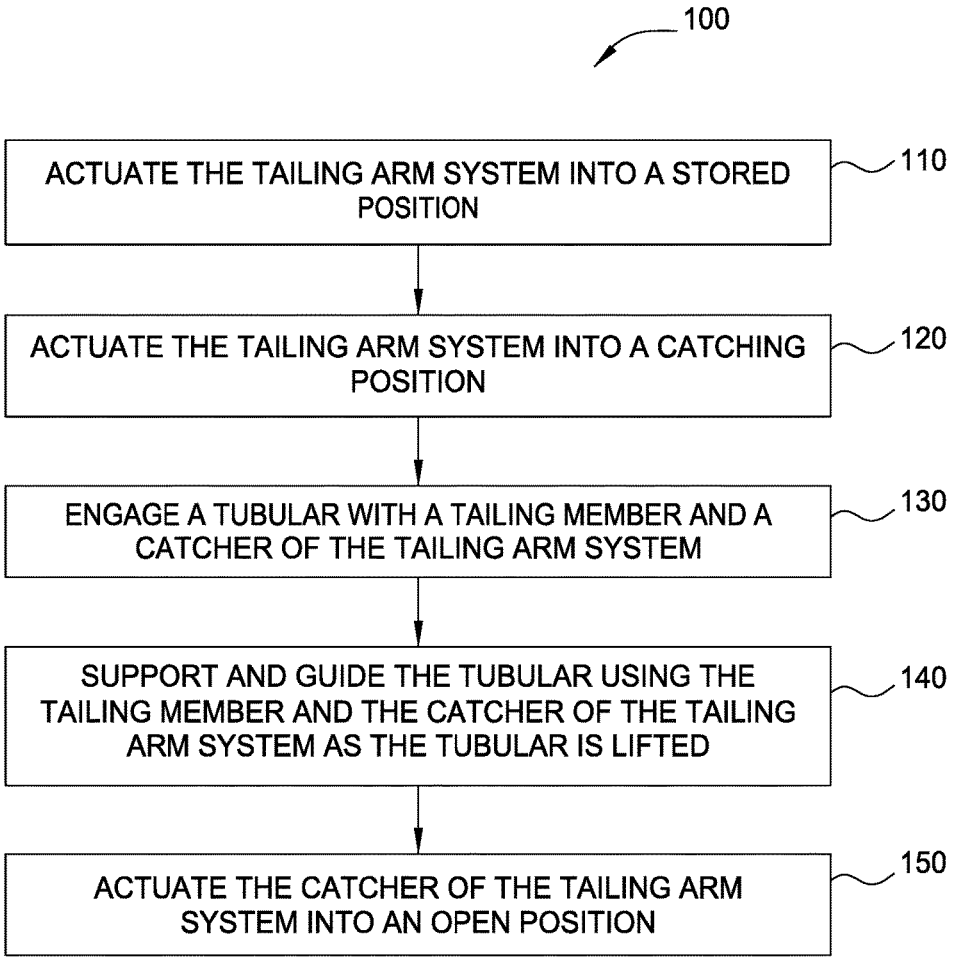
FIG. 8 schematically illustrates operations of a method for operating the tubular handling system.

FIG. 8 schematically illustrates operations of a method 100 for operating a tubular handling system, such as tubular handling system 10 which includes a catwalk and a tailing arm system, such as tailing arm system 8. The method 100 generally relates to embodiments where a tubular, such as tubular 30, is lifted off of the catwalk, such as catwalk 1, from a substantially horizontal or slightly angled position to a substantially vertical position. The tubulars are guided by the tailing arm system to prevent uncontrolled movement of a tailing end of the tubular. The method 100 may be used when transferring tubulars onto a rig floor.

At operation 110, the tailing arm system is actuated into a stored position, such that a tailing member and a catcher of the tailing arm system are positioned substantially parallel to a trough of the catwalk. At operation 120, the tailing arm system is actuated into a catching position to receive a tubular and prevent the tubular from swinging uncontrollably off of the trough of the catwalk. At operation 130, the tailing end of the tubular is engaged with the tailing member and the catcher of the tailing arm system as the tubular is lifted by a hoist off of the trough of the catwalk from a substantially horizontal or slightly angled position to a substantially vertical position.

At operation 140, the tailing end of the tubular is supported and guided by the tailing member and the catcher of the tailing arm system to ensure that the tubular does not collide with the rig floor, a deck hand, other personnel, or any other objects in the vicinity of the tubular. As the tailing end of the tubular is lifted off of the catwalk, the tailing arm system controls the movement of the tubular into desired locations and at desired speeds and times. At operation 150, the catchers are actuated into an open position after the tubular has been stabilized to allow the tubular to be moved to another location on the rig floor.

Figure 9:
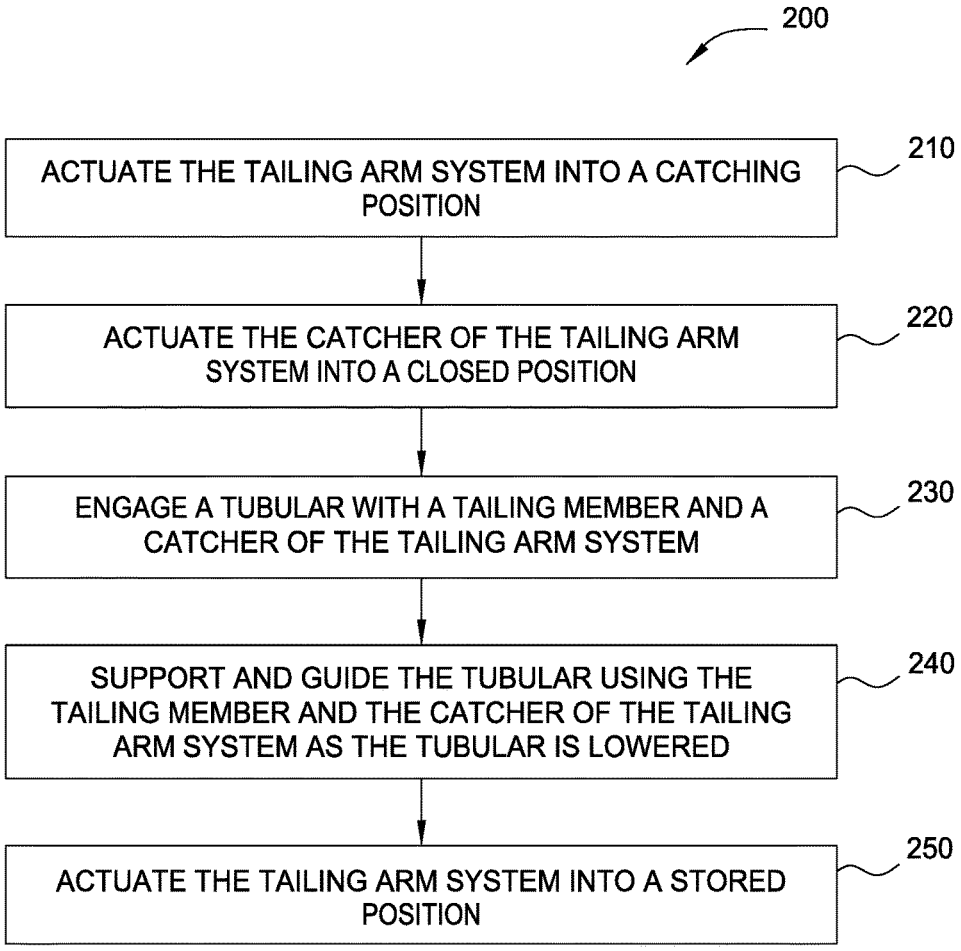
FIG. 9 schematically illustrates operations of a method for operating the tubular handling system.

FIG. 9 schematically illustrates operations of a method 200 for operating a tubular handling system, such as tubular handling system 10 which includes a catwalk and a tailing arm system, such as tailing arm system 8. The method 200 generally relates to embodiments where a tubular, such as tubular 30, is positioned onto the catwalk, such as catwalk 1, from a substantially vertical position to a substantially horizontal or slightly angled position. The tubulars are guided by the tailing arm system to prevent uncontrolled movement of a tailing end of the tubular. The method 200 may be used when transferring tubulars from a rig floor onto the trough of the catwalk.

At operation 210, the tailing arm system is actuated into a catching position to receive a tubular that is held in a substantially vertical position on a rig floor by a hoist. At operation 220, the catcher of the tailing arm system is actuated into a closed position such that the catcher may engage the tubular. At operation 230, the tailing end of the tubular is engaged with the tailing member and the catcher of the tailing arm system as the tubular is lowered by the hoist onto the trough of the catwalk from the substantially vertical position to a substantially horizontal or slightly angled position.

At operation 240, the tailing end of the tubular is supported and guided onto the trough of the catwalk by the tailing member and the catcher of the tailing arm system as the tubular is lowered by the hoist. Once the tailing end of the tubular has contacted the trough, the tubular may slide or be pulled down the trough such that the tubular is moved from the substantially vertical position to the substantially horizontal or slightly angled position on the trough. At operation 250, the tailing arm system is actuated into a stored position where the longitudinal axis of the tailing member and the catcher is substantially parallel to and adjacent the longitudinal axis of the trough of the catwalk.

The tubular handling system 10, including the tailing arm system 8, is configured to handle tubulars of any size, ranging between about a one inch diameter to about a thirty-five inch diameter, without the need of any additional equipment of modification of the tubular handling system 10 or the tailing arm system 8. The tubular handling system 10 and the tailing arm system 8 increases the safety of individuals on the rig floor when moving a tubular from the trough of the catwalk onto the rig floor by preventing uncontrolled swinging of the tailing end of the tubular. The tubular handling system 10 and the tailing arm system 8 safely move the tailing end of the tubular off of and onto the trough of the catwalk.

While the foregoing is directed to embodiments of the invention, other and further embodiments of the invention may be devised without departing from the basic scope thereof, and the scope thereof is determined by the claims that follow.

We claim:

1. A tubular handling system, comprising:

a catwalk having a trough with a top, trough tailing end, and two side faces;

a first tailing member releasably coupled to the trough via said two side faces, near said trough tailing end such that said first tailing member does not extend past said tailing end when said first tailing member is in a stored position;

a first catcher coupled to the first tailing member, wherein the catcher is moveable relative to the first tailing member;

a second tailing member with a second catcher, wherein the second tailing member is coupled to the first tailing member near said trough tailing end such that said second tailing member does not extend past said tailing end when said second tailing member is in a stored position, and a support structure coupled to the first tailing member at one end and coupled to the trough at an opposite end such that said support structure does not extend past said tailing end when said support structure is in a stored position, wherein the support structure is configured to move the first tailing member relative to the trough to guide a tubular from a substantially horizontal or slightly angled position to a substantially vertical position.

2. The tubular handling system of claim 1, wherein the second catcher is rotatable relative to the second tailing member.

3. The tubular handling system of claim 1, wherein the first tailing member is rotatable relative to the trough about a pivot point.

4. The tubular handling system of claim 3, wherein the support structure includes a rod member coupled at one end to the first tailing member and coupled at an opposite end to the trough, wherein the rod member is extendable and retractable to move the first tailing member about the pivot point.

5. The tubular handling system of claim 1, wherein the support structure includes a rod member that is extendable from and retractable into a cylinder to move the first tailing member relative to the trough.

6. The tubular handling system of claim 5, wherein the rod member is extendable from and retractable into the cylinder using at least one of a hydraulic, pneumatic, electric, and mechanical force.

7. The tubular handling system of claim 1, wherein the second tailing member with the second catcher is configured to support the tubular from a side opposite the first tailing member and first catcher.

8. A method of moving a tubular from a substantially horizontal or slightly angled position in a trough with a top, trough tailing end, and two side faces of a catwalk, to a substantially vertical position on a rig floor, the method comprising:

providing a first tailing arm system, with a first tailing member and a first tailing catcher, near said trough tailing end such that said first tailing member does not extend past said trough tailing end when said first tailing member is in a stored position, and a second tailing member with a second catcher, wherein the second tailing member is coupled to the first tailing system near said trough tailing end such that said second tailing member does not extend past said trough tailing end when said second tailing member is in a stored position;

actuating the first tailing arm system into a catching position such that said first tailing member with said first catcher of the first tailing arm system are configured to engage a tailing end of the tubular while a leading end of the tubular is lifted from the trough relative to the catwalk, wherein said second tailing member with said second catcher is coupled to one end of the first tailing member, and wherein an opposite end of the first tailing member is coupled to and movable relative to the trough via said two side faces;

engaging the tailing end of the tubular with the second catcher of said second tailing member as the tubular is lifted; and guiding the tailing end of the tubular with the second catcher of said second tailing member from the trough to the rig floor by moving the first tailing member relative to the trough to move the tubular into the substantially vertical position.

9. The method of claim 8, wherein the first tailing member is movable about a pivot point where the opposite end of the first tailing member is coupled to the trough via said two side faces.

10. The method of claim 8, further comprising moving the first tailing member relative to the trough via said two side faces by actuating a support structure that is coupled to the first tailing member at one end and coupled to the trough via said two side faces at an opposite end.

11. The method of claim 10, wherein the support structure includes a rod member that is movable using at least one of a hydraulic, pneumatic, electric, and mechanical force.

12. The method of claim 10, wherein the support structure includes a rod member that is extendable from and retractable into a cylinder using a pressurized fluid.

13. The method of claim 8, further comprising actuating the second catcher with a second tailing member into an open position where a longitudinal axis of the second catcher with a second tailing member is substantially parallel to a longitudinal axis of the first tailing member.

14. The method of claim 8, further comprising actuating the first tailing arm system into a stored position where a longitudinal axis of the first tailing member and the catcher with a second tailing member is substantially parallel and adjacent to the longitudinal axis of the trough via said two side faces.

15. A method of moving a tubular from a substantially vertical position on a rig floor to a substantially horizontal or slightly angled position in a trough with a top, trough tailing end, and two side faces of a catwalk, the method comprising:

providing a first tailing arm system with a first tailing member and a first tailing catcher, near said trough tailing end such that said first tailing member does not extend past said trough tailing end when said first tailing member is in a stored position, and a second tailing member with a second catcher, wherein the second tailing member is coupled to the first tailing system near said trough tailing end such that said second tailing member does not extend past said trough tailing end when said second tailing member is in a stored position;

actuating the first tailing arm system into a catching position such that said first tailing member with said first catcher and said second tailing member with said second catcher of the first tailing arm system are configured to engage a tailing end of the tubular while a leading end of the tubular is lowered onto the trough, wherein the second tailing member with said second catcher is coupled to one end of the first tailing member, and wherein an opposite end of the first tailing member is coupled to and movable relative to the trough via said two side faces;

engaging the tailing end of the tubular with the second catcher of said second tailing member as the tubular is lowered; and guiding the tailing end of the tubular with the second catcher of said second tailing member from the rig floor to the trough by moving the first tailing member relative to the trough via said two side faces to move the tubular into the substantially horizontal or slightly angled position.

16. The method of claim 15, further comprising moving the first tailing member relative to the trough via said two side faces by actuating a support structure that is coupled to the first tailing member at one end and coupled to the trough via said two side faces at an opposite end.

17. The method of claim 15, further comprising actuating the second catcher with a second tailing member into an open position where a longitudinal axis of the second catcher with a second tailing member is substantially parallel to a longitudinal axis of the first tailing member.

18. The method of claim 15, further comprising actuating the first tailing arm system into a stored position where a longitudinal axis of the first tailing member and the second catcher with a second tailing member is substantially parallel and adjacent to the longitudinal axis of the trough via said two side faces.

* * * * *